US009022693B1

(12) United States Patent
Menard

(10) Patent No.: US 9,022,693 B1
(45) Date of Patent: May 5, 2015

(54) RAPID DEPLOYABLE FLOATING PRODUCTION SYSTEM

(71) Applicant: The Williams Companies, Inc., Tulsa, OK (US)

(72) Inventor: Stafford J. Menard, Houston, TX (US)

(73) Assignee: The Williams Companies, Inc., Tulsa, OK (US)

( * ) Notice: Subject to any disclaimer, the term of this patent is extended or adjusted under 35 U.S.C. 154(b) by 0 days.

(21) Appl. No.: 13/941,263

(22) Filed: Jul. 12, 2013

(51) Int. Cl.
*B63B 35/44* (2006.01)

(52) U.S. Cl.
CPC ..... *B63B 35/44* (2013.01)

(58) Field of Classification Search
CPC .... E02D 25/00; B63B 35/44; B63B 2035/442
USPC ..... 405/196, 197, 203, 205, 207, 223.1, 405/224
See application file for complete search history.

(56) References Cited

U.S. PATENT DOCUMENTS 4,702,321 A 10/1987 Horton
4,738,567 A * 4/1988 McGillivray et al. ..... 405/227
5,044,828 A * 9/1991 Berner et al. ..... 405/202
5,431,512 A * 7/1995 Haney ..... 405/224
5,558,467 A 9/1996 Horton
5,609,442 A 3/1997 Horton
5,722,797 A 3/1998 Horton, III
5,833,397 A 11/1998 Horton, III
5,931,602 A * 8/1999 Gulbrandsen et al. ..... 405/224
6,206,614 B1 3/2001 Blevins et al.
6,817,309 B2 11/2004 Horton
6,854,933 B2 2/2005 Horton, III
6,884,003 B2 4/2005 Horton, III
6,899,492 B1 * 5/2005 Srinivasan ..... 405/205
6,935,810 B2 8/2005 Horton, III
7,188,574 B2 3/2007 Converse et al.
7,217,066 B2 * 5/2007 O'Sullivan ..... 405/224
7,413,384 B2 8/2008 Horton, III et al.
7,553,106 B2 6/2009 Horton, III et al.
7,565,877 B2 * 7/2009 Sablok et al. ..... 114/264
7,871,222 B2 * 1/2011 Ding et al. ..... 405/200
7,891,909 B2 2/2011 Tahar et al.
8,696,291 B2 * 4/2014 Haney et al. ..... 414/141.9
2004/0258483 A1 * 12/2004 Vatsvag ..... 405/203

* cited by examiner

*Primary Examiner* — Benjamin Fiorello
(74) *Attorney, Agent, or Firm* — Crowe & Dunlevy

(57) ABSTRACT

A floating production system includes a jacket and a deck supported by the jacket. The jacket includes a plurality of legs and a plurality of braces connected between the plurality of legs. The plurality of braces are connected between the legs along substantially the entire length of each leg to provide a stiffened space frame. Two or more of the plurality of legs may further include a longitudinally oriented launch cradle.

8 Claims, 5 Drawing Sheets

RAPID DEPLOYABLE FLOATING PRODUCTION SYSTEM

FIELD OF THE INVENTION

The present invention generally relates to the production of petroleum from offshore reserves and more particularly, but not by way of limitation, to a floating production system capable of rapid deployment.

BACKGROUND OF THE INVENTION

For many years, petroleum has been recovered from subterranean reservoirs through the use of drilled wells and production equipment. Petroleum hydrocarbons may be produced in a variety of forms, including liquid crude oil, natural gas and light condensates. The discovery of significant offshore petroleum reserves has lead to the development of an industry dedicated to the design, manufacture and operation of sophisticated drilling and production equipment.

The production of petroleum from offshore reserves typically involves the placement of equipment on a floating structure above the subsea well. There are currently four basic floating hull forms utilized by the deepwater offshore industry: ship-shape, tension leg platforms (TLP), semi-submersibles, and spars. When utilized for the production of petroleum products, each of these types of floating structures can be regarded as a "floating production system."

In many cases, a floating production system is designed and manufactured for a specific installation. The floating production system is sized and designed to support the maximum production from the producing field. Over time, however, as production from the field diminishes, the floating production system may only use a small fraction of its maximum capacity. In this way, the significant cost of the large-scale floating production system cannot be efficiently recovered while the system is operating at a less-than-optimal capacity. When the cost of operating the large-scale floating production system cannot be adequately offset by the declining production, the field is often abandoned.

There is, therefore, a need for a method for more cost-effectively and completely producing hydrocarbons from offshore reservoirs after a decline in the production. It is to these and other objects that the present invention is directed.

SUMMARY OF THE INVENTION

In preferred embodiments, the present invention provides a floating production system that includes a jacket and a deck supported by the jacket. The jacket includes a plurality of legs and a plurality of braces connected between the plurality of legs. The plurality of braces are connected between the legs along substantially the entire length of each leg to provide a stiffened space frame. Two or more of the plurality of legs may further include a longitudinally oriented launch cradle.

In another aspect, the preferred embodiments include a method for moving the floating production system on a body of water. The jacket of the floating production system is constructed on skid ways, loaded onto a launch barge, transported offshore and horizontally launched at site. The jacket is then rotated to vertical using controlled ballasting of select ballast compartments. The mooring system is then attached holding the jacket in place and the topside is lifted and set on the jacket completing the installation.

DETAILED DESCRIPTION OF PREFERRED EMBODIMENTS

Figure 1:
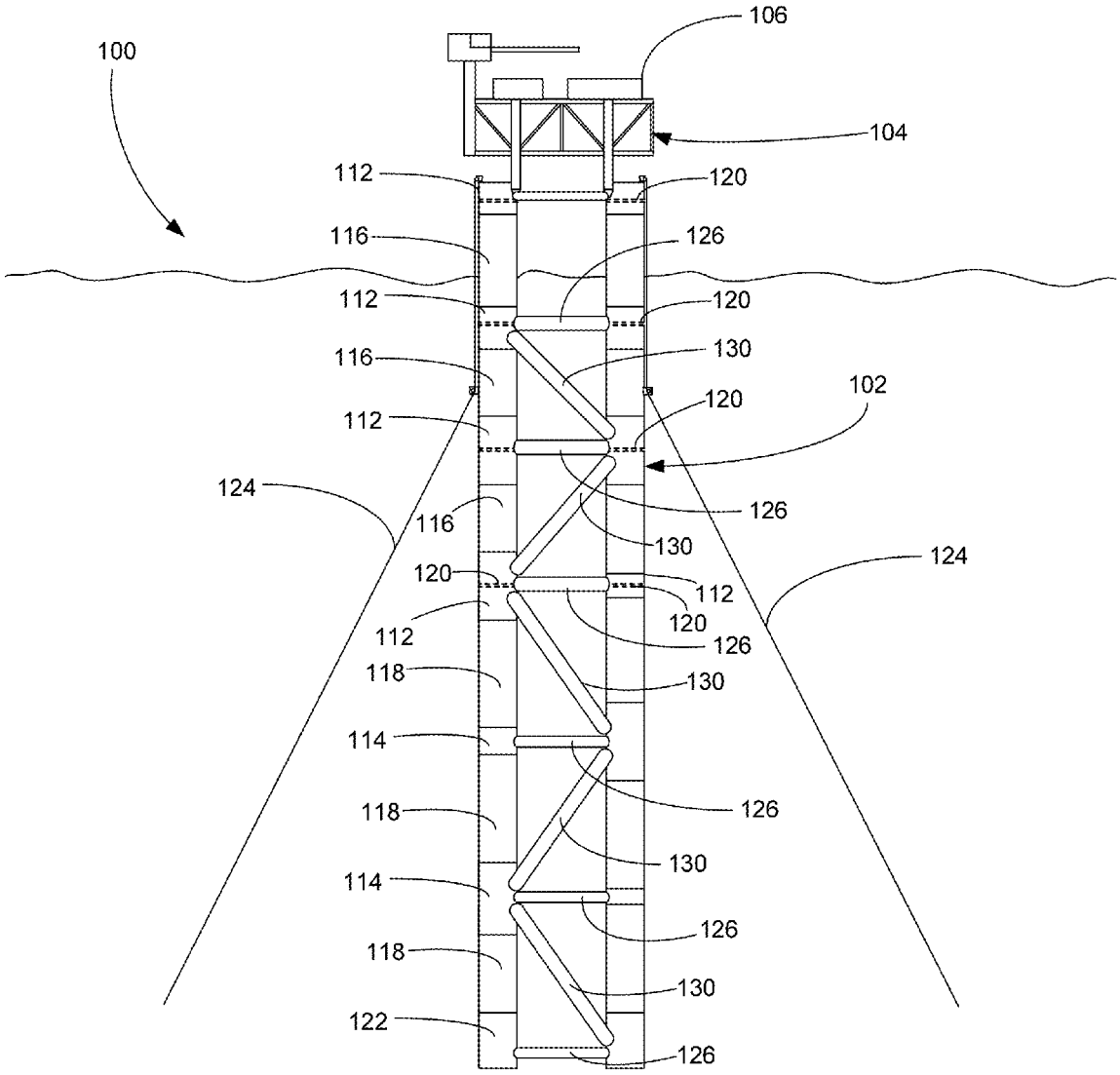
FIG. 1 presents an elevational view of a deepwater floating production system constructed in accordance with a preferred embodiment.

Referring to FIG. 1, shown therein is a floating production system 100 constructed in accordance with a presently preferred embodiment. In preferred embodiments, the floating production system 100 is particularly well suited for use in connection with the production of oil and gas from marginal (small) reservoirs and end-of-life reservoirs. It will be appreciated, however, that although the floating production system 100 includes features that permit the use of the floating production system 100 in certain small-scale applications, the floating production system 100 will also find utility in larger production environments. The floating production system 100 is also well suited for the rapid deployment to offshore locations for assisting with test wells.

The floating production system 100 includes a jacket 102, a deck 104 and surface facilities 106 mounted on the deck 104. The surface facilities 106 may include, for example, pumps, process vessels, storage tanks, generators, living quarters, cranes, helipads and other resources and equipment typically found on offshore floating production systems. The surface facilities are preferably installed on the deck 104 and placed onto the jacket 102 after the jacket 102 has been moved into a production position. The deck 104 includes a plurality of deck legs 105 that support the deck 104 and surface facilities 106 on the jacket 102.

The jacket 102 generally includes a plurality of large diameter vertical legs 108 and interconnecting bracing 110. In the particularly preferred embodiment depicted in FIG. 1, the jacket 102 includes four vertical legs 108. The combination of the vertical legs 108 and bracing 110 creates a rigid frame space across the entire height of the jacket 102. Thus, unlike prior art systems that only include braces at discrete locations between vertical legs, the jacket 102 includes rigid bracing 110 along the length of the jacket 102.

Each of the legs 108 includes one or more hard tank joint cans 112 and one or more soft tank joint cans 114. Each of the hard tank joint cans 112 are connected by hard tank leg sections 116. Each of the soft tank joint cans 114 are connected by soft tank leg sections 118. The hard tank joint cans 112 and soft tank joint cans 114 are preferably reinforced to support the loading forces exerted by the bracing 110. The collection of hard tank joint cans 112 or soft tank joint cans 114 disposed at the same depth on the legs 108 are referred to as a "level" of hard tank joint cans 112 or soft tank joint cans 114. Thus, as depicted in FIG. 1, there are hour levels of hard tank joint cans 112 and two levels of hard tank joint cans 114.

Each of the hard tank joint cans 112 preferably includes a horizontally disposed watertight bulkhead 120. The hard tank joint cans 112 and hard tank leg sections 116 create a substantially watertight, buoyant chamber within the leg 108. In contrast, each of the soft tank joint cans 114 and soft tank leg sections 118 are configured to be flooded. In a particularly preferred embodiment, the hard tank joint cans 112, hard tank leg sections 116, soft tank joint cans 114 and soft tank leg sections 118 near the bottom of the jacket 102 are longer than the corresponding hard tank joint cans 112, hard tank leg sections 116, soft tank joint cans 114 and soft tank leg sections 118 near the surface.

In the particularly preferred embodiment depicted in FIG. 1, the jacket 102 further includes a ballast chamber 122 positioned at the bottom of each leg 108. In this way, when loaded with the deck 104 and surface facilities 106, the jacket 102 establishes a center of gravity for the floating production system 100 that is below the center of buoyancy. The jacket 102 provides a stable, self-righting platform for the deck 104. The jacket 102 preferably includes mooring lines 124 that extend downward from the floating production system 100 to maintain the position of the floating production system 100 over the targeted subsea structures.

Notably, unlike prior art spars, the jacket 102 does not include an outer skin around the hard tank. The absence of an external skin reduces the impact of wave, current and wind forces on the jacket 102.

Figure 2:
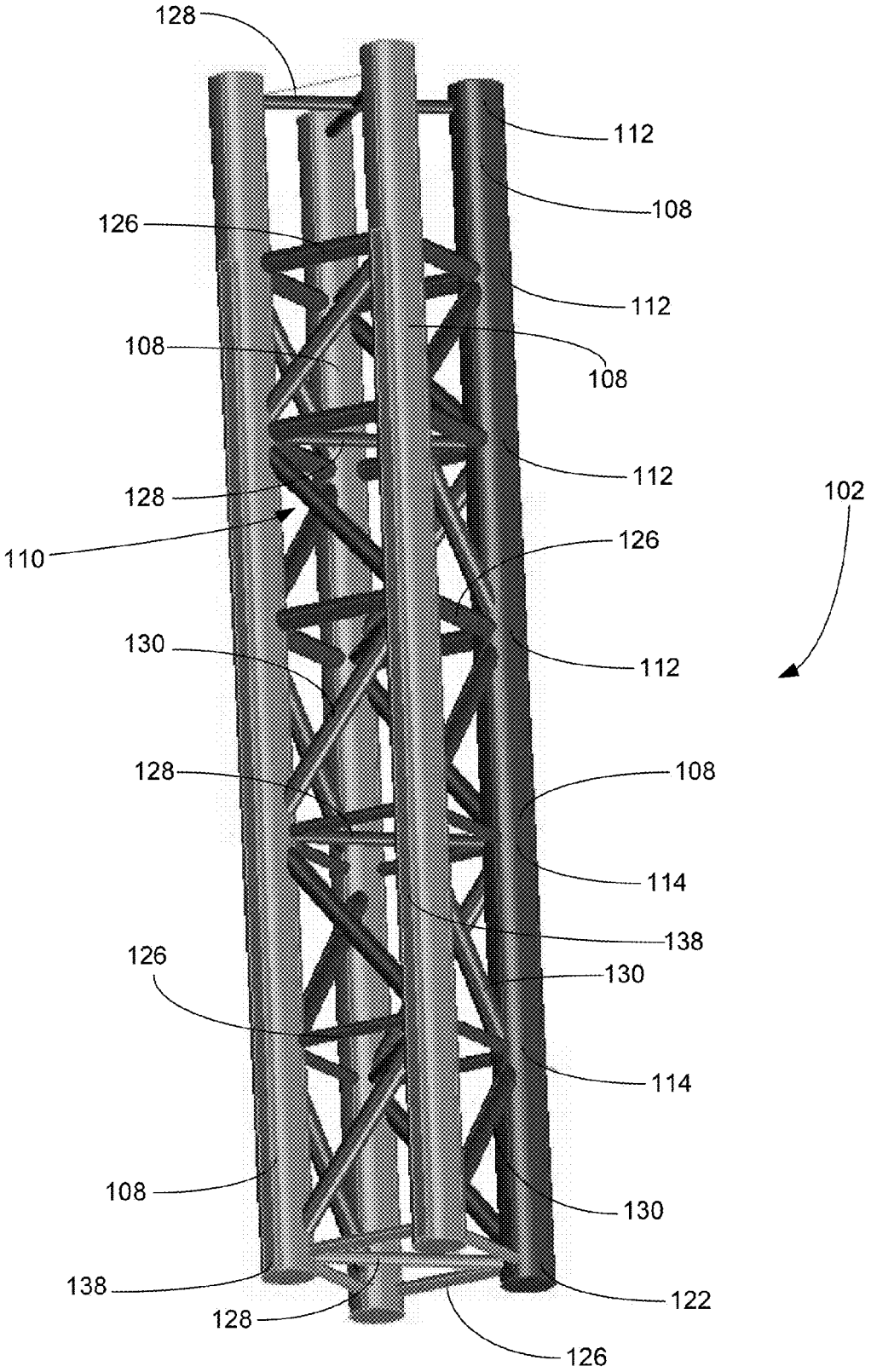
FIG. 2 is a perspective view of the jacket of the floating production system of FIG. 1.

Turning to FIG. 2, shown therein is a perspective view of the jacket 102 of FIG. 1. The bracing 110 generally include horizontal peripheral braces 126, horizontal interior braces 128 and diagonal peripheral braces 130. Each of these bracing 110 is preferably welded or otherwise affixed to a hard tank joint can 112 or soft tank joint can 114.

Each horizontal peripheral brace 126 extends substantially horizontally between two hard tank joint cans 112 or soft tank joint cans 114 located on adjacent legs 108 within the same level. In contrast, each horizontal interior brace 128 extends substantially horizontally between two hard tank joint cans 112 or soft tank joint cans 114 located on opposite legs 108 within the same level. The diagonal peripheral braces 130 extend between hard tank joint cans 112 and/or soft tank joint cans 114 between adjacent levels.

In the particularly preferred embodiment depicted in FIG. 2, each level of hard tank joint cans 112 and soft tank joint cans 114 includes four horizontal peripheral braces 126 and one horizontal interior brace 128. The horizontal interior brace 128 preferably alternates position between adjacent levels within the jacket 102. The preferred embodiment includes four diagonal peripheral braces 130 between each level. In the particularly preferred embodiment depicted in FIG. 2, the angular orientation of the diagonal peripheral braces 130 are the same between two particular levels, but alternate angular orientation at each level of hard tank joint cans 112 and soft tank joint cans 114. The jacket 102 preferably includes two intersecting horizontal interior braces 128 between two or more levels within the jacket 102. In a particularly preferred embodiment, there are two intersecting horizontal interior braces 128 between the uppermost level of hard tank joint cans 112.

Figure 3:
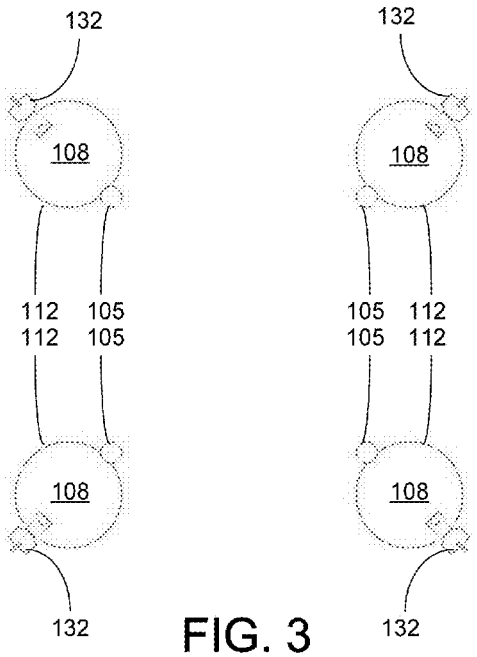
FIG. 3 is a top plan view of the legs of the jacket at approximately 60 feet about the waterline.
Figure 5:
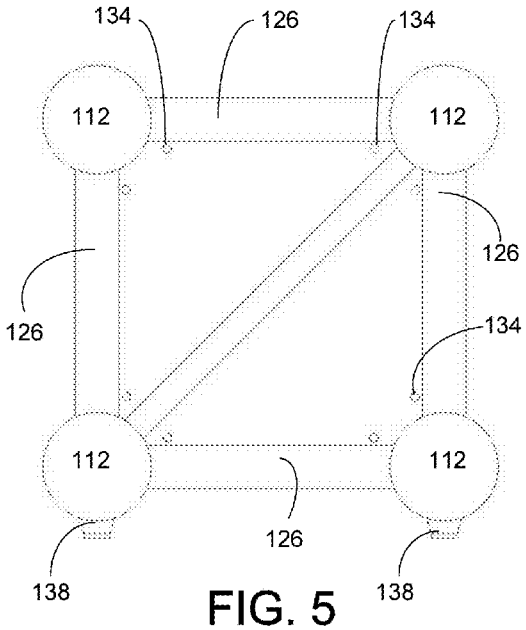
FIG. 5 is a top plan view of the legs of the jacket at approximately 30 feet below the waterline.

Referring now to FIGS. 3-9, shown therein are plan views of the legs 108 and bracing 110 at various depths along the jacket 102. Beginning with FIG. 3, shown therein is a plan view of the legs 108 above the uppermost level of hard tank joint cans 112 near the deck 104. Each leg 102 includes a chain jack 132 which can be used in connection with the mooring lines 124 to stabilize the floating production system 100. The deck legs 105 of the deck 104 are preferably connected and supported by the interior surface of the legs 108.

Figure 4:
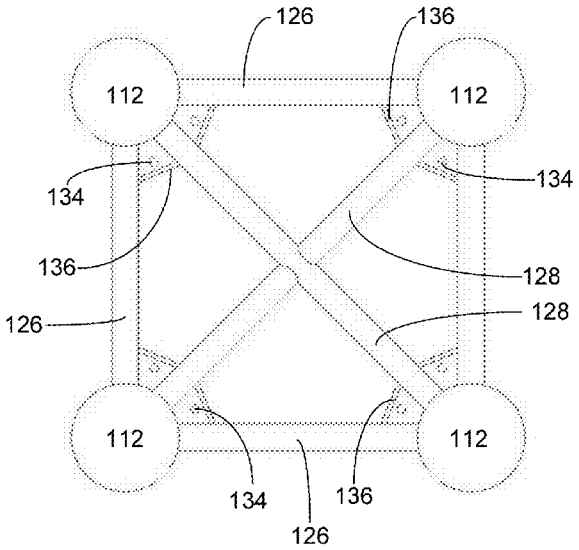
FIG. 4 is a top plan view of the legs of the jacket at approximately 50 feet about the waterline.
Figure 6:
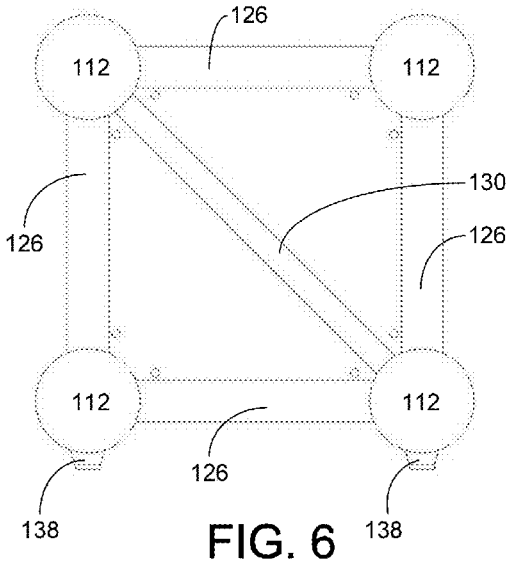
FIG. 6 is a top plan view of the legs of the jacket at approximately 110 feet below the waterline.
Figure 7:
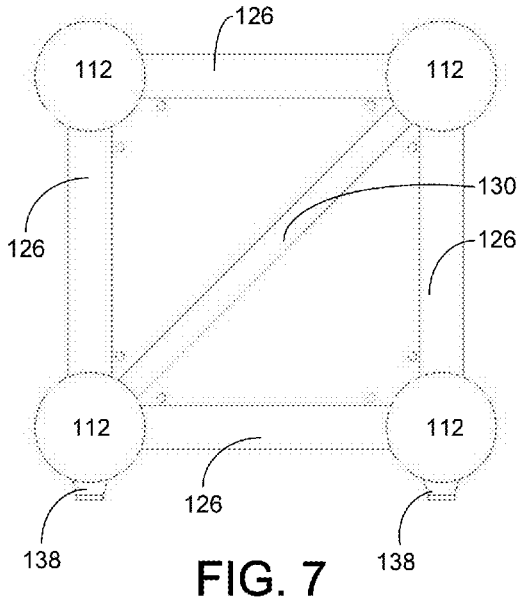
FIG. 7 is a top plan view of the legs of the jacket at approximately 200 feet below the waterline.
Figure 9:
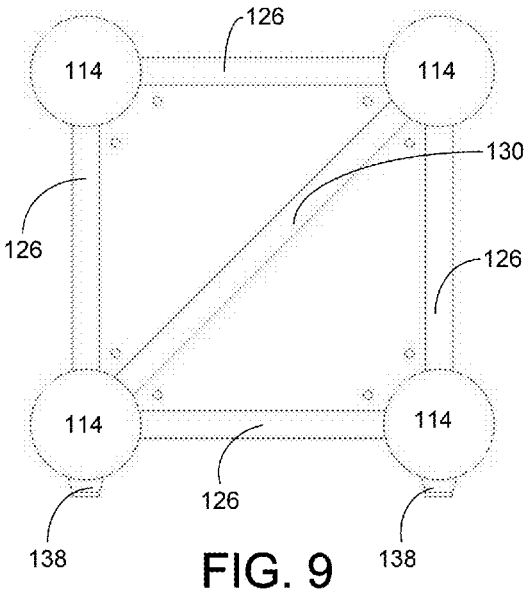
FIG. 9 is a top plan view of the legs of the jacket at approximately 400 feet below the waterline.
Figure 8:
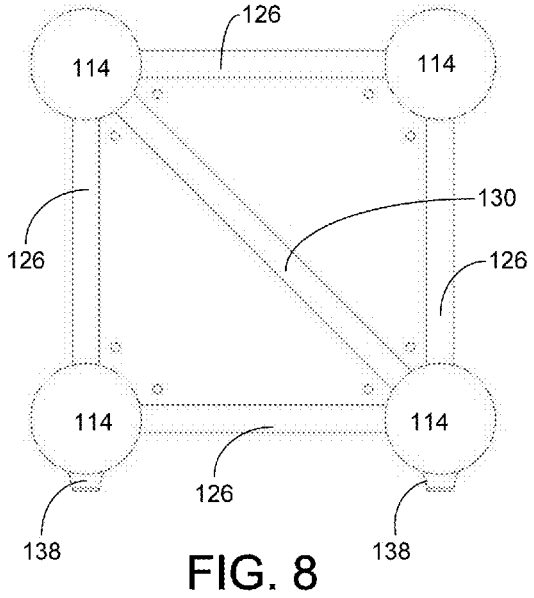
FIG. 8 is a top plan view of the legs of the jacket at approximately 300 feet below the waterline.

Turning to FIG. 4, shown therein is a top plan view of the legs 108 at the first level of hard tank joint cans 112. As depicted in FIG. 4, the floating production system 100 includes a plurality of pull tubes 134. The pull tubes 134 may include, for example, incoming flow lines, export lines, umbilicals and future flow lines. The jacket 102 may optionally include a plurality of guides 136 extending between the legs 108 and the horizontal interior brace 128. The guides 136 prevent the pull tubes 134 from exhibiting an unacceptable level of lateral displacement.

Figure 10:
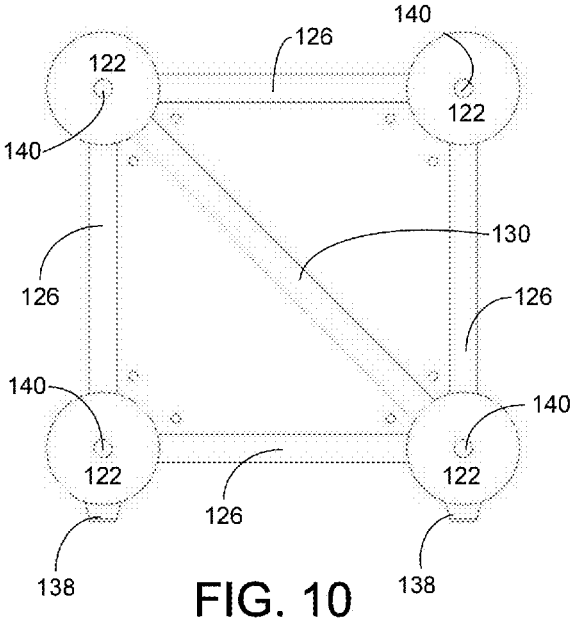
FIG. 10 is a top plan view of the legs of the jacket at approximately 500 feet below the waterline.

Turning to FIGS. 4-7, shown therein are plan views of the first, second, third and fourth levels of the hard tank joint cans 112. FIGS. 6-9 illustrate plan views of the fifth and sixth levels which constitute soft tank joint cans 114 in the preferred embodiment. As illustrated in these drawings, at least two of the legs 108 each include a longitudinally oriented launch cradle 138. The launch cradle 138 provides a reinforced base to support the weight of the jacket 102 in a horizontal position. The launch cradle 138 is preferably configured to facilitate the sliding movement of the jacket 102 during launch. Turning to FIG. 10, the ballast chambers 122 each include a flood port 140 that permits water to enter the ballast chambers 122 and soft tank joint cans 114 and soft tank leg sections 118.

Although the structure of the jacket 102 has been described with reference to the structures depicted in FIGS. 1-10, it will be understood that the present invention is not so limited. Preferred embodiments may include alternative configurations of the legs 108 and bracing 110.

Figure 11:
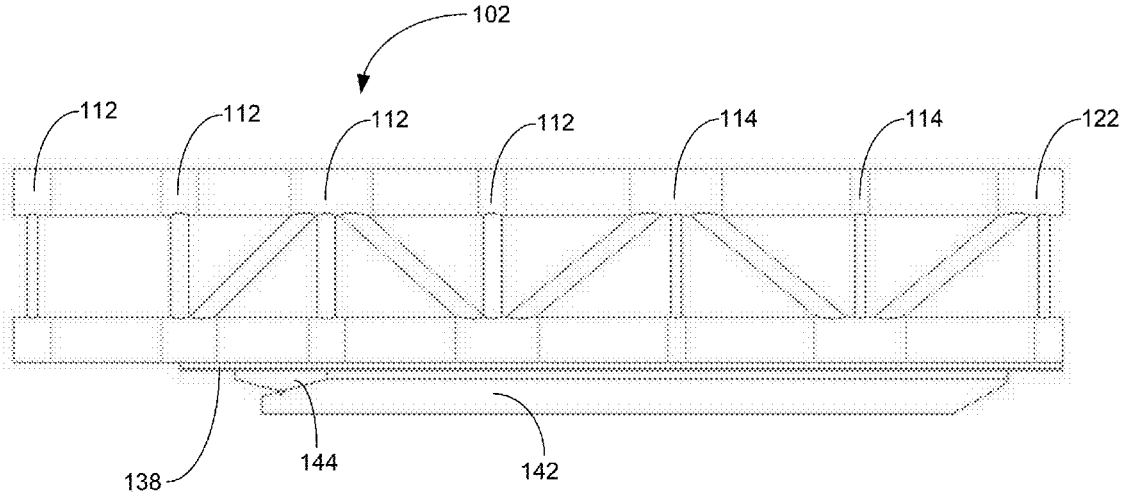
FIG. 11 is a side view of the jacket of the floating production system of FIG. 1 supported by a transportation barge.

Turning to FIG. 11, shown therein is a depiction of the jacket 102 resting on a transportation barge 142. The transportation barge preferably includes a selectively tilting launch platform (or rocker arm) 144. The launch cradles 138 support the jacket 102 on the transportation barge 142. Unlike prior art spar systems, the presence of bracing 110 along the length of the jacket 102 provides enough rigidity to permit the floating production system 100 to be transported on and launched from the transportation barge 142. The ability to move the jacket 102 on the transportation barge 142 presents a significant improvement over prior art spar systems that must be towed horizontally through the water due to a lack of rigidity.

When the transportation barge 142 has been towed to the desired location, the transportation barge 142 is ballasted down on the stern and the jacket 102 is forcibly moved down the transportation barge 142 to the stern. The jacket 102 may be moved with winches, jacks or other equipment suitable for inducing movement of the jacket 102 down the transportation barge 142.

As the jacket 102 is moved to the stern of the transportation barge 142, the stern of the transportation barge 142 and the upper portions of the jacket drop in the water. The jacket 102 will eventually achieve self-sustained movement in the stern direction without the assistance. When the center of gravity of the jacket 102 passes over the launch platform 144, the launch platform 144 will rock about its pivot point and allow the aft portion of the jacket 102 to lift from the transportation barge 142. The jacket 102 will then slide from the launch platform 144 into the water. Once the jacket 102 has separated from the transportation barge 142, the jacket 102 will rise to the surface and float horizontally.

Once the jacket 102 is floating in the water, the selective flooding of the soft tank joint cans 114 and soft tank leg sections 118 causes the jacket 102 to orient in a vertical position where the center of gravity is below the center of buoyancy. The mooring lines 124 are then attached to hold the jacket 102 in place. Slurried magnetite or other fixed ballast can then be pumped or otherwise transferred into the ballast chambers 122. Once the jacket 102 has been stabilized, the deck 104 can be then lifted and set on top of the jacket 102.

Thus, in a broad sense, the floating production system 100 includes an improved jacket 102 that includes a unique bracing system and launch cradles 138 that provide sufficient structural rigidity and support to permit the floating production system 100 to be transported on horizontally and launched from a floating barge.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed and as defined in the appended claims.

What is claimed is:

1. A floating production system comprising:

a jacket, wherein the jacket comprises a plurality of legs, wherein each of the plurality of legs has a length and a cross-sectional area, wherein the plurality of legs further comprise four legs arranged in a substantially rectangular configuration and wherein each of the four legs further comprise:

one or more hard tank joint cans;

one or more soft tank joint cans;

one or more hard tank leg sections;

one or more soft tank leg sections; and wherein the one or more hard tank joint cans and the one or more soft tank joint cans are each situated in a corresponding one of the four legs at levels along the length of the four legs; and a plurality of braces connected between the legs, wherein the plurality of braces are connected between the legs along substantially the entire length of each leg and wherein the plurality of braces further comprise:

a plurality of horizontal peripheral braces, wherein the horizontal peripheral braces extend between hard tank joint cans in adjacent legs at the same level;

a plurality of horizontal interior braces; and a plurality of diagonal peripheral braces.

2. The floating production system of claim 1, wherein the horizontal interior braces extend between the hard tank joint cans in opposite legs at the same level.

3. The floating production system of claim 1, wherein the diagonal peripheral braces extend between hard tank joint cans in adjacent legs at different levels.

4. The floating production system of claim 1, wherein four of the hard tank joint cans on each level are each connected to two horizontal peripheral braces and two diagonal peripheral braces.

5. The floating production system of claim 1, wherein two of the hard tank joint cans on each level are each connected to a horizontal interior brace.

6. The floating production system of claim 1, wherein each of the four legs further comprises a ballast chamber.

7. The floating production system of claim 6, wherein each of the four legs further comprises a launch cradle.

8. A floating production system comprising:

a truss-reinforced jacket, wherein the jacket comprises:

a plurality of legs, wherein two or more of the plurality of legs includes a launch cradle, wherein each of the plurality of legs further comprise:

one or more hard tank joint cans;

one or more soft tank joint cans;

one or more hard tank leg sections; and one or more soft tank leg sections; and a plurality of braces connected between the plurality of legs, wherein the plurality of braces are connected between the legs along substantially the entire length of each leg, wherein the plurality of braces further comprise:

a plurality of horizontal peripheral braces;

a plurality of horizontal interior braces, wherein the horizontal peripheral braces extend between hard tank joint cans in adjacent legs at the same level; and a plurality of diagonal peripheral braces.

* * * * *